United States Patent [19]

Hetzel et al.

[11] 4,447,861

[45] May 8, 1984

[54] CIRCULAR FLUORESCENT LAMP UNIT

[75] Inventors: Frederick Hetzel, Brookpark; Martin J. Graf, Wickliffe; Douglas Seredich, Chardon, all of Ohio

[73] Assignee: General Electric Company, Schenectady, N.Y.

[21] Appl. No.: 333,200

[22] Filed: Dec. 21, 1981

[51] Int. Cl.[3] ..... F21S 5/00

[52] U.S. Cl. ..... 362/216; 362/396; 362/418

[58] Field of Search ..... 362/216, 396, 418, 42 P, 362/430

[56] References Cited

U.S. PATENT DOCUMENTS 2,507,074 5/1950 Wiedenhoeft ..... 362/216

2,769,083 10/1956 Archer ..... 362/216

2,963,574 12/1960 Pfaff ..... 362/216

*Primary Examiner*—Donald P. Walsh

*Attorney, Agent, or Firm*—Philip L. Schlamp; Fred Jacob

[57] ABSTRACT

A circular fluorescent lamp unit having a central screw-in hub containing lamp ballast means, and a plurality of support arms extending from the hub and having curved outer ends to support a circular lamp. The support arms are metal or plastic strips which enter through slots of the hub and are bent at substantially right angles within the hub so as to be held in place while having limited radial movement with respect to the hub to enable them to accommodate and support circular lamp bulbs of varying dimensions such as due to manufacturing tolerance variations.

2 Claims, 3 Drawing Figures

CIRCULAR FLUORESCENT LAMP UNIT

CROSS-REFERENCE TO RELATED APPLICATION

Ser. No. 333,199 Rudolph Metoff, "Circular Fluorescent Lamp Unit", filed concurrently herewith and assigned the same as this invention.

BACKGROUND OF THE INVENTION

The invention is in the field of circular lamp units, such as screw-in units having a circular fluorescent lamp and a ballast.

Various types of screw-in fluorescent lamp units have been devised, for taking the place of incandescent lamps in ceiling sockets and in table lamps and floor lamps, and are economical to operate and conserve electrical energy because they consume less than half the electrical energy than incandescent lamps for the same brightness. U.S. Pat. No. 4,258,287 to Frederick Hetzel and U.S. Pat. No. 4,278,911 to Rudolph Metoff each discloses a screw-in central hub containing a ballast, and a replaceable circular lamp assembly including a circular bulb and spokes, positioned on the hub. U.S. Pat. Nos. 4,161,020 to Miller; 2,525,022 to Dupuy; 3,059,137 to Reaves; 2,534,956 to Pistey; and 2,534,955 to Dazley disclose other typical techniques for holding a circular lamp bulb, in which the support arms are hinged or slotted.

SUMMARY OF THE INVENTION

Object of the invention are to provide an improved circular lamp unit which is attractive in appearance, economical to manufacture, and which readily accommodates replaceable circular fluorescent light bulbs of varying dimensions, and particularly the circular diameter, such as due to manufacturing tolerance variations.

The invention comprises, briefly and in a preferred embodiment, a circular fluorescent lamp unit having a central screw-in hub containing lamp ballast means, and a plurality of support arms extending from the hub to support a circular lamp. The support arms are metal or plastic strips which enter through slots of the hub and are bent at substantially right angles within the hub so as to be held in place while having limited radial movement with respect to the hub to enable them to accommodate and support circular lamp bulbs of varying dimensions such as due to manufacturing tolerance variations.

DESCRIPTION OF THE PREFERRED EMBODIMENT

Figure 1:
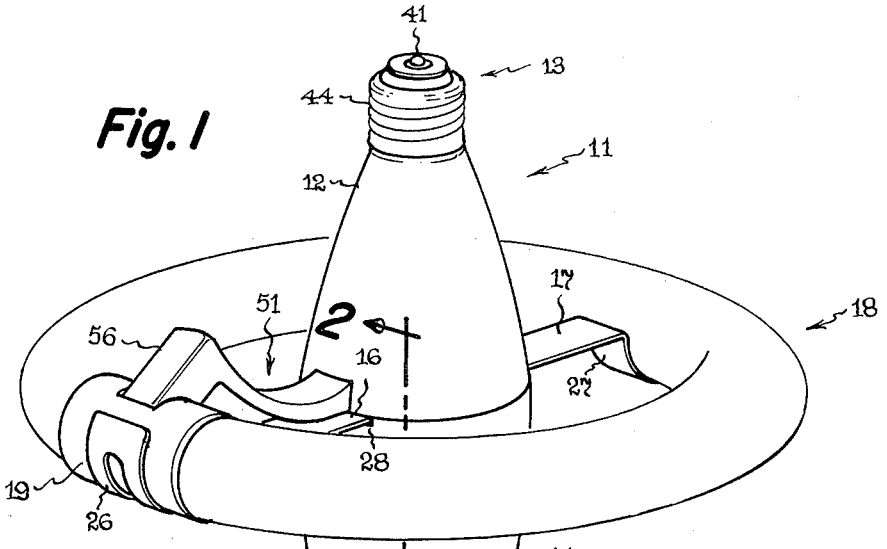
FIG. 1 is a perspective view of a preferred embodiment of the invention, showing a lamp unit having support arms holding a circular light bulb and also having and electrical connector member connected to the light bulb.
Figure 2:
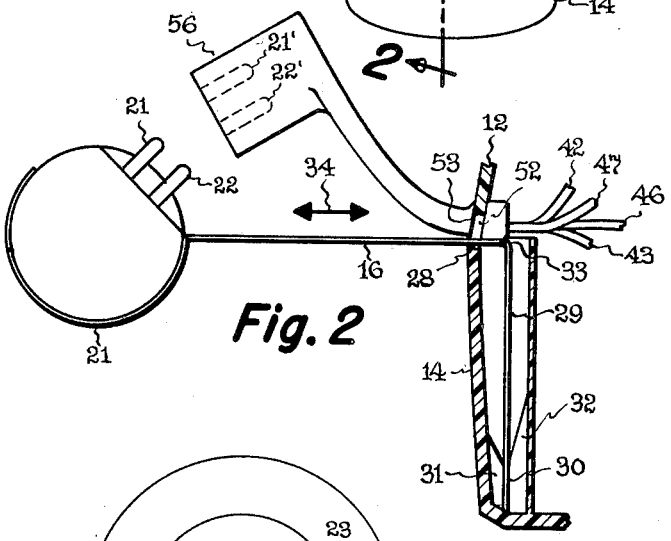
FIG. 2 is a side sectional view of a portion of FIG. 1, taken on the line 2—2 thereof, showing details of the support arms and also showing the electrical connector member disconnected from the light bulb.

The circular lamp unit comprises a central hub 11 having a two-part plastic housing consisting of a tapered section 12 having a threaded screw base 13 attached to the small end thereof and adapted to fit household or other threaded sockets, and a cylindrical cap section 14 attached to the section 12 by suitable means such as is disclosed in the above-referenced Hetzel patent. The hub 11 is hollow and contains a ballast and starter switch, as will be described.

A pair of light bulb support arms 16, 17 of sheet metal or plastic extend laterally from the hub 11 at mutually opposite sides thereof, and support and hold in position a circular light bulb 18. The light bulb 18 is provided with a conventional four-pin connector base plug 19 having pairs of connector pins 21, 22 connected respectively to ends of cathodes 23, 24 contained in the lamp 18. The outer end regions 26, 27 of the support arms 16, 17 are curved to partly surround and snugly and resiliently hold the lamp 18, one of these end regions 26 preferably being at and partly around the lamp plug 19. The lamp 18 thus is removable from and replaceable in the support arm end regions 26, 27.

In accordance with the invention, one or both of the support arms 16, 17 extends through slots 28 in the wall of the hub cap 14 and are held in the hub cap 14 by a bent inner region 29, at approximately right angles to the lateral portions 16 and 17, of which the outer end 30 is fixedly supported in position by ribs 31, 32 of the cap 14, and the portion of the region 29 near the bend 33 is free to move so that the arm 16 (and/or arm 17) is slidable in and out from the hub 11 a short distance, such as about an eighth or a quarter of an inch, as indicated by the double arrow 34, so that the support arms can readily adjust in length to accommodate and hold circular lamps 18 of slightly varying diameters such as due to manufacturing tolerance variations. The slot 28, right angle bend 33, and anchoring of the bent end 30, function to prevent any substantial movement of the support arms 16, 17 in directions other than radially as indicated by double arrow 34, whereby the support arms hold the bulb 18 firmly in place.

The slots 28 for the support arms are at the rim of the hub cap 14, and the inner region lengths 29 of the support arms extend within the cap 14 and parallel to the hub axis. The hub cap ribs 31, 32 form a receptacle for the end 30 of the inner support arm length 29, preventing any substantial lateral movement of this end 30. The support arms 16, 17 are quickly and economically attached to the hub during manufacture, by sliding the inner length region 29 into the cap 14 so that its end 30 fits into the receptacle provided by ribs 31, 32 and its lateral portion fits into the slot 28; no screws or other fastening devices are required.

The hub 11 contains a conventional lamp ballast means 36, such as an inductor, resistor or capacitor, and may also contain a conventional glow starter switch 37 which alternatively may be contained with the lamp connector plug 19. At the end of the ballast 36 is connected to the button contact 41 of base 13, and the other end thereof is electrically connected, via a wire 42, to the connector terminal 22 of cathode 23. Another wire 43 connects the threaded shell 44 of base 13 to the connector terminal 22 of cathode 24, and wires 46 and 47 respectively connected the starter switch 37 across the connector terminals 21 of cathodes 23 and 24.

Figure 3:
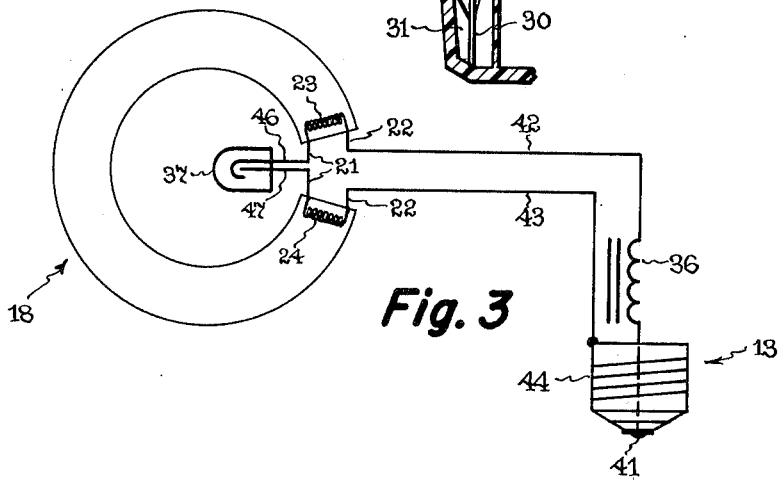
FIG. 3 is an electrical circuit diagram of the lamp unit.

The connector wires 42, 43, 46, and 47 may be carried by and/or embeded in, and are a part of, an elongated resilient electrical connector member 51, preferably of rubber or plastic having a lateral groove 52 near an end thereof which fits into a slot 53 of the hub 11 and thus locks the connector member to the hub, with the connection wires 42, 43, 46 and 47 extending from the inner end of the connector member and into the hub for connection to the ballast 36 and starter switch 37. The hub locking slot 53 is located in the tapered hub section 12 adjacent to the flat side of support arm 16 so that the connector 51 is in alignment with and extends substantially along the support arm 16. The connector member 51 includes an angular socket portion 56 and its outer end which contains two pairs of connector receptacles 21' and 22' adapted to connect over the lamp plug pairs of terminals 21, 22 when the socket protion 56 is pushed over these terminals, to provide an operative lamp circuit as shown in FIG. 3, the pairs of connector receptacles 21', 22' being suitably connected to the ends of the wires 42, 43, 46 and 47 within the socket portion 56. The lamp 18 is easily replaceable by pulling the connector socket 56 from the lamp and removing the lamp from its support arms 16, 17. The hub and ballast unit outlasts the lives of several light bulbs. To facilitate the bending of the connector member 51 when connecting it to or disconnecting it from a lamp, its cross-section is preferably rectangular with its narrower dimension in the direction of its flexing, as shown in the drawing, thus making it more flexible and easier to bend when connecting and disconnecting lamps. The width or larger cross-section dimension of the connector 51 may be approximately the same as that of the support arm 16. The connector member 51 is disclosed and claimed in the above-referenced patent application.

The invention provides an arrangement of support arms for a replaceable circular light bulb which is easy to use, economical to manufacture, which accommodates bulbs of varying dimensions, and which is unobtrusive and neat in appearance.

While preferred embodiments and modifications of the invention have been shown and described, various other embodiments and modifications thereof will become apparent to persons skilled in the art and will fall within the scope of the invention as defined in the following claims.

What we claim as new and desire to secure by United States Letters Patent is:

1. A circular fluorescent lamp unit comprising a central hub containing lamp ballast means, a plurality of support arms extending radially from said hub and adapted to hold a circular fluorescent lamp in a position surrounding said hub, at least one of said support arms comprising a sheet member extending through a support arm slot in said hub and having a substantially right-angle bend within said hub to form an inner length thereof within said hub which extends substantially parallel to the hub axis, and said hub further comprising receptacle means for securing said sheet member at the end region of said inner length spaced from said right-angle bend to provide means causing one or more of said support arms to have a limited amount of radial sliding movement with respect to said hub.

2. A lamp unit as claimed in claim 1, in which said hub comprises two parts joined together at rims thereof, said hub having a respective support arm slot disposed at the rim of one of said hub parts for each respective one of said support arms, and each of said support arms has an inner length extending into said one hub part, said receptacle means comprising means for receiving the respective end regions of said inner lengths of the support arms.

* * * * *